US006302717B1

(12) United States Patent
Cheung

(10) Patent No.: US 6,302,717 B1
(45) Date of Patent: Oct. 16, 2001

(54) MULTIPLE SOCKET ELECTRIC ADAPTER

(76) Inventor: Tat Kwong Cheung, Flat 12, 15/F., Laurels Industrial Centre, 32 Tai Yau Street, San Po Kong, Kowloon (HK)

( * ) Notice: Subject to any disclaimer, the term of this patent is extended or adjusted under 35 U.S.C. 154(b) by 0 days.

(21) Appl. No.: 09/255,019

(22) Filed: Feb. 22, 1999

(51) Int. Cl.[7] ..... H01R 29/00
(52) U.S. Cl. ..... 439/172; 439/694
(58) Field of Search ..... 439/131, 166, 439/171, 172, 173, 174, 956, 694

(56) References Cited

U.S. PATENT DOCUMENTS

| | | | |
|---|---|---|---|
| 5,159,545 | 10/1992 | Lee | 363/146 |
| 5,211,584 | 5/1993 | Lee | 439/652 |
| 5,791,921 | 8/1998 | Lee | 439/172 |
| 5,851,123 * | 12/1998 | Chou | 439/172 |

FOREIGN PATENT DOCUMENTS

| | | |
|---|---|---|
| 31 09 620 | 9/1982 | (DE) . |
| WO 97/23022 | 6/1997 | (WO) . |

OTHER PUBLICATIONS

Australian Patent Office, International search report for corresponding Hong Kong Short–Term patent application, Ref No.CS/00/038 (Jul. 13, 2000).

* cited by examiner

*Primary Examiner*—Neil Abrams
*Assistant Examiner*—Michael C. Zarroli
(74) *Attorney, Agent, or Firm*—Hall, Priddy, Myers & Vande Sande

(57) ABSTRACT

A universal adapter that can be adjusted to engage with many types of sockets. On one end, the adapter has at least two holes which can engage with a plug of an electric appliance. These holes are electrically connected with electrically conductive pin members, which are selectively extensible through one of a plurality of pairs of apertures on the other end of the adapter and are engageable with a socket. At least two pairs of these apertures are inclined to one another at an angle. The adapter also includes a third pin member made of an electrically insulating material which is extensible through an aperture on said other end of the adapter and which can be engaged with the ground pin hole of a socket.

30 Claims, 11 Drawing Sheets

MULTIPLE SOCKET ELECTRIC ADAPTER

BACKGROUND OF THE INVENTION

This invention relates to a universal adapter and, in particular, such an adapter which can be used in various countries in the world in which the wall sockets are differently structured.

There are now various portable electrical appliances which can be operated by the user during travelling in other countries. Such appliances may include portable computers, mobile phones and facsimile machines. In order to adapt to the differences in the voltage of municipal power supply, many such products are installed with a built-in voltage converter, which allows the user to step up or step down the voltage of a municipal power supply, as desired.

Another problem associated with the use of such appliances in various countries is that the shape and arrangement of the holes in wall sockets may vary from country to country. There are now four types of wall-socket arrangements in the world. In Great Britain, Hong Kong, Singapore, etc., the wall sockets are of BS type, and include three rectangular holes. In such countries as the US, Canada, Japan and Taiwan, the wall sockets are of UL type, and include two flat holes. In other European countries, the wall sockets are of VDE type, and include two round holes. In Australia and New Zealand, the wall sockets are of SAA type, and include two inclined flat holes.

DESCRIPTION OF THE PRIOR ART

In view of the above situation, various electrical adapters have been devised for allowing the many electrical appliances to be used around the world. However, most such adapters are very bulky, at least when compared with conventional electric plugs or sockets. In addition, a relatively high amount of metal is required for making the components in such adapters, which add to the manufacturing cost.

U.S. Pat. No. 5,159,545 issued to Lee discloses a universal adapter including a casing and three plugs, in which the plugs may be selectively moved forward to engage with holes in the wall socket. Each of these three plugs contains pins of a different shape, so that the adapter can be plugged into different wall sockets in different countries. It can, however, be seen that a different plug is used for plugging into wall sockets of different shapes and arrangement of holes. Such an adapter also suffers from the same problems enumerated in the last paragraph, i.e. it is both bulky and requires a high amount of metal for its production.

It is therefore an object of the present invention to provide a universal adapter in which the aforesaid shortcomings are mitigated, or at least to provide a useful alternative to the public.

SUMMARY OF THE INVENTION

The first two aspects of this invention are directed to a universal adapter that has a body and a pair of electrically conductive pin members. This body includes at least a first end and a second end and has at least two holes on said first end. These holes are adapted to be engaged with a plug of an electric appliance and each of said holes is electrically connected with one of said electrically conductive pin members which are selectively extensible through a plurality of pairs of apertures provided on said second end, wherein at least two pairs of those apertures are, in the first aspect of the invention, inclined to one another at an angle or, in a second aspect of this invention, of different size. The pin members are engagable with a socket. In the first two aspects of this invention said adapter also includes a third pin member made of an electrically insulating material, said third member being extensible through an aperture on said second end of said body to engage with a ground pin hole of a socket.

A third aspect of this invention is directed to an universal adapter that has a body and a pair of electrically conductive pin members. This body includes at least a first end and a second end and has at least two holes on said first end. These holes are adapted to be engaged with a plug of an electric appliance and are electrically connected with said pin members which are selectively extensible through a plurality of pairs of apertures provided on said second end, wherein each of said pin members is engageable with an adapting member when said pin members extend through one of said pairs of apertures. The pin members are engagable with a socket.

A fourth aspect of this invention is directed to a universal adapter that has a body and a pair of electrically conductive pin members. This body includes at least a first end and a second end and has at least two holes on said first end. These holes are adapted to be engaged with a plug of an electric appliance and are electrically connected with said pin members, which are selectively extensible through a plurality of pairs of apertures provided on said second end, wherein said second end includes at least a first surface and a second surface which are substantially perpendicular to each other, and wherein at least one pair of apertures is provided on each of said first and second surface(s). The pin members are engagable with a socket.

BRIEF DESCRIPTION OF THE DRAWINGS

A preferred embodiment of the present invention will now be described, with reference to the accompanying drawings, in which.

DETAILED DESCRIPTION OF THE PREFERRED EMBODIMENT

Figure 1:
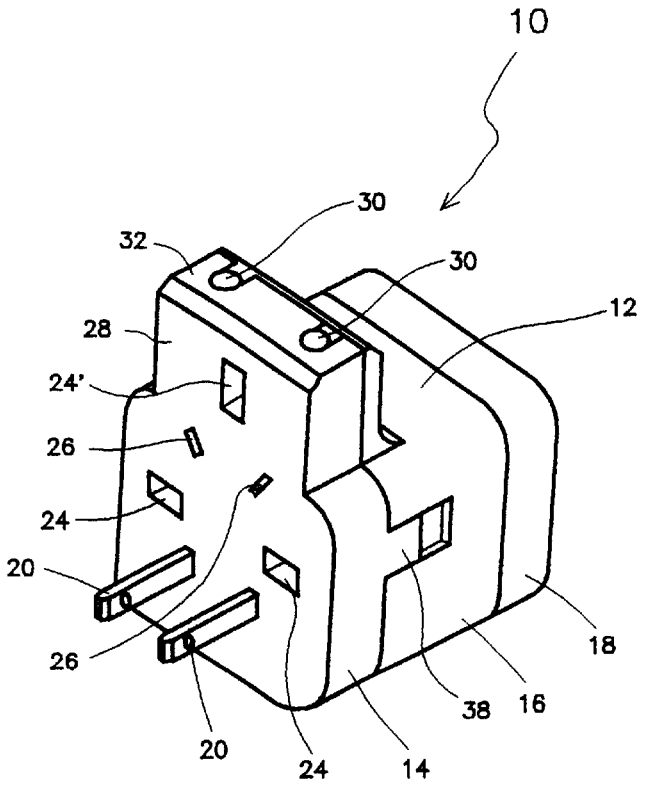
FIG. 1 is a front perspective view of a universal adapter according to the present invention.
Figure 2:
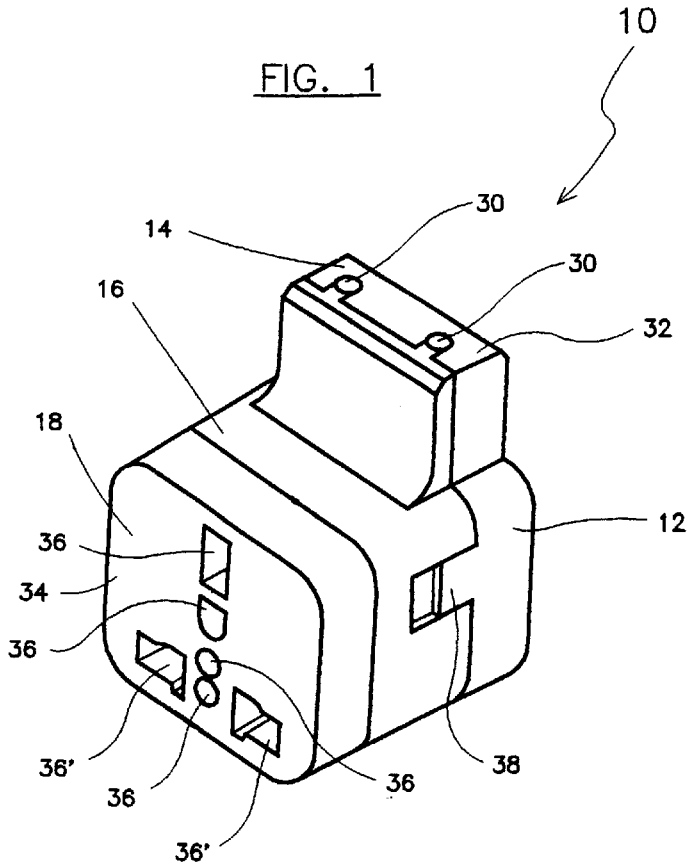
FIG. 2 is a rear perspective view of the universal adapter shown in FIG. 1.
Figure 3:
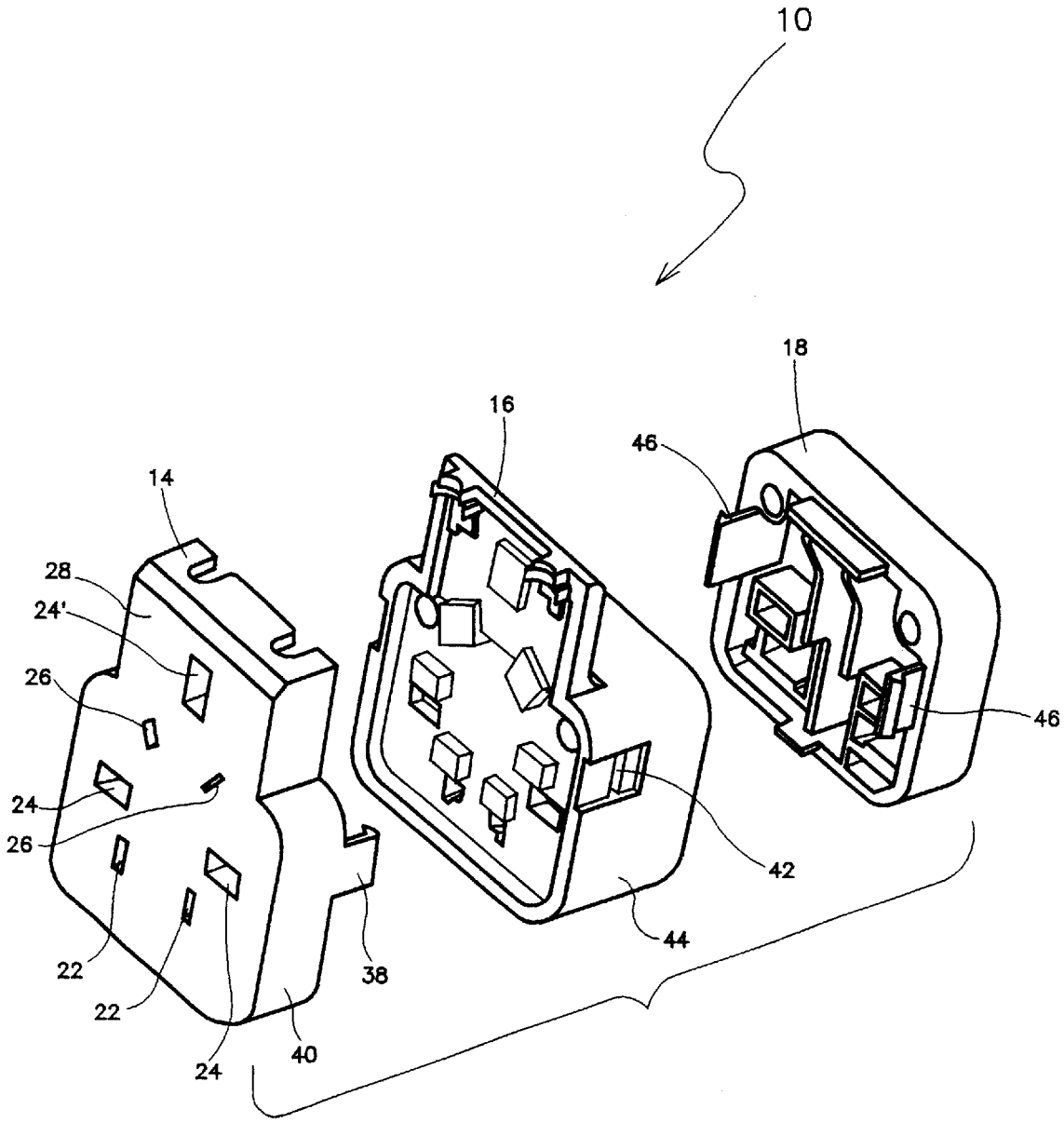
FIG. 3 is an exploded view of the universal adapter shown in FIG. 1, with the electrically conductive pins removed for clarity purposes.

A universal adapter according to the present invention is shown in FIGS. 1 to 3, and generally designated as 10. The adapter 10 includes a body portion 12, comprising a first body part 14, a second body part 16 and a third body part 18. Extending from the first body part 14 are a pair of pins 20 which are made of an electrically conductive material, e.g. copper. The pins 20 may be inserted into a wall socket for obtaining electricity therefrom.

The first body part 14 is provided with three pairs of apertures 22, 24 and 26 on a major surface 28 thereof. On the upper part of the major surface 28 of the first body part 14 is also provided an aperture 24' which is intended to be used in conjunction with the apertures 24. The first body part 14 and the second body part 16 combine to form a pair of circular apertures 30 on a minor surface 32 formed when the first body part 14 and the second body part 16 are engaged with each other.

It can be seen that the apertures 22 are at an right angle to the apertures 24. The apertures 26 are inclined at an acute angle to the apertures 24, and are inclined at an obtuse angle to the apertures 22. It can also been seen that while the apertures 22 and 26 are of substantially the same size and shape, the apertures 24 and 24' are of a larger size. In addition, while the apertures 22, 24, 24' and 26 are rectangular in shape, the holes 30 are circular in shape.

It can be seen that, in FIG. 1, the pair of electrically conductive pins 20 extend from the interior part of the body portion 12 of the adapter 10, out of the major surface 28 of the first body part 14, and through the apertures 22. Such an arrangement allows the adapter 10 to be plugged into a UL type wall socket used in the US, Canada, Japan and Taiwan. In ways to be discussed below, the pins 20 may also selectively extend from the interior part of the body portion 12 of the adapter 10, out of the major surface 28 of the first body part 14, and through the aperture pairs 24, 26 and 30 respectively, in order to enable the adapter 10 to be engaged with various types of wall sockets.

Referring in particular to FIG. 2, it can be seen that the third body part 18 of the body portion 12 of the adapter 10 includes a major surface 34 on which are provided a number of socket holes 36 and 36', into which pins of various kinds of plugs (whether two-pin type or three-pin type, and whether flat-pin type or round-pin type), e.g. of an electrical appliance (not shown), may be inserted in order to be in an electrically-connected relationship with the pins 20. It should be noted that the socket holes 36' are always used irrespective of the type of plug used, and they are the only socket holes which are in an electrically connected relationship with the pins 20. By way of such an arrangement, when the adapter 10 is plugged into a wall socket, and the plug of the electrical appliance is plugged into the appropriate socket holes 36, 36' of the adapter 10, electric power can be obtained from the municipal power supply for the operation of the electrical appliance.

The first body part 14 includes a pair of engagement claws 38 (of which only one is shown in FIG. 3) on its side walls 40. Each of the claws 38 is receivable within a recess 42 (of which only one is shown in FIG. 3) on a side wall 44 of the second body part 16, in order to releasably engage the first body part 14 with the second body part 16. The engagement between the claws 38 and the recesses 42 may be released manually, so as to allow the arrangement of the pins 20 to be changed as necessary.

Figure 5:
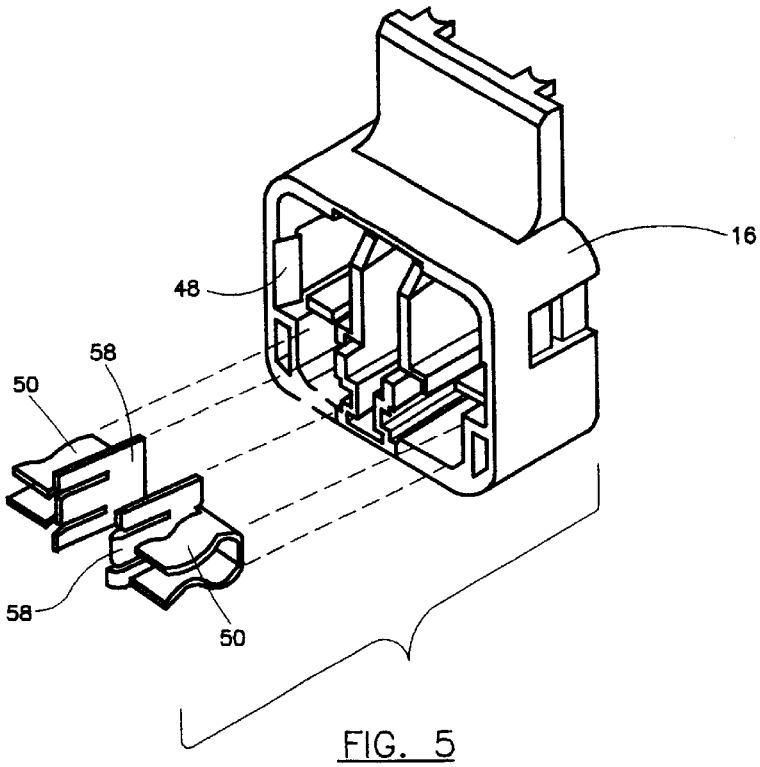
FIG. 5 is rear perspective view of the second body part of the universal adapter shown in FIG. 1, showing its connection with the output socket clips.
Figure 6:
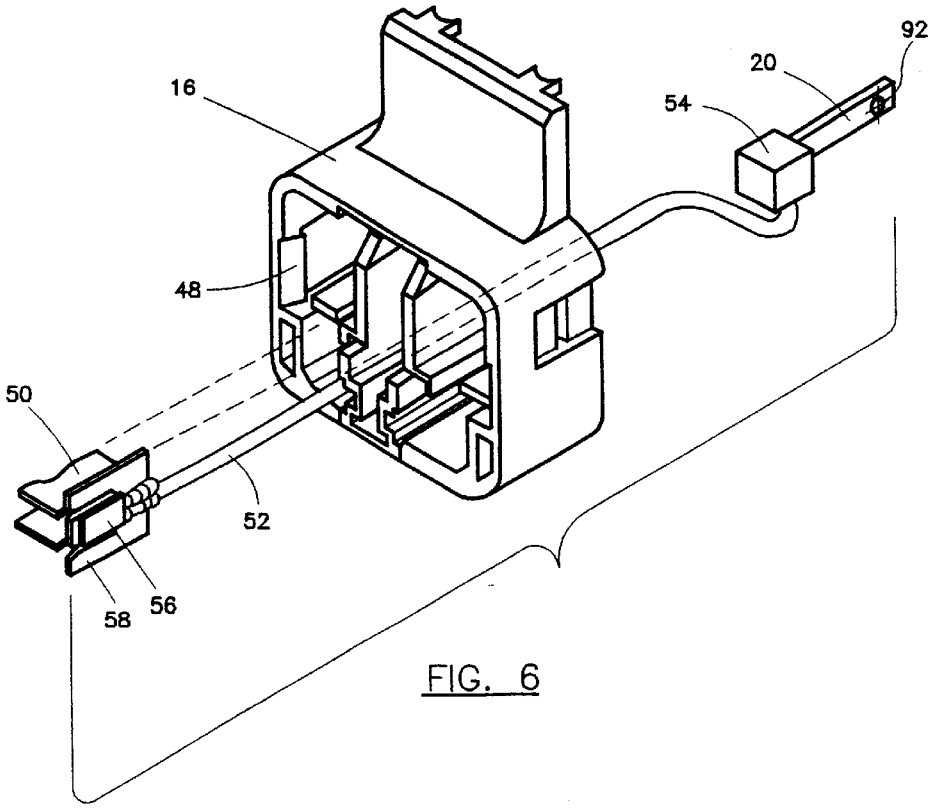
FIG. 6 is a rear perspective view of the middle body part of the universal adapter shown in FIG. 1, showing connection of an output socket clip with the electrically conductive pin via a connecting platelet.

The third body part 18 also includes a pair of engagement claws 46 which are engageable with corresponding engagement surfaces 48 of the second body part 16 (see FIGS. 5 and 6). As the claws 46 and the surfaces 48, once they are engaged, cannot be accessed from outside, it is not possible to manually release the engagement between the second body part 16 and the third body part 18 once they are assembled with each other.

Figure 4:
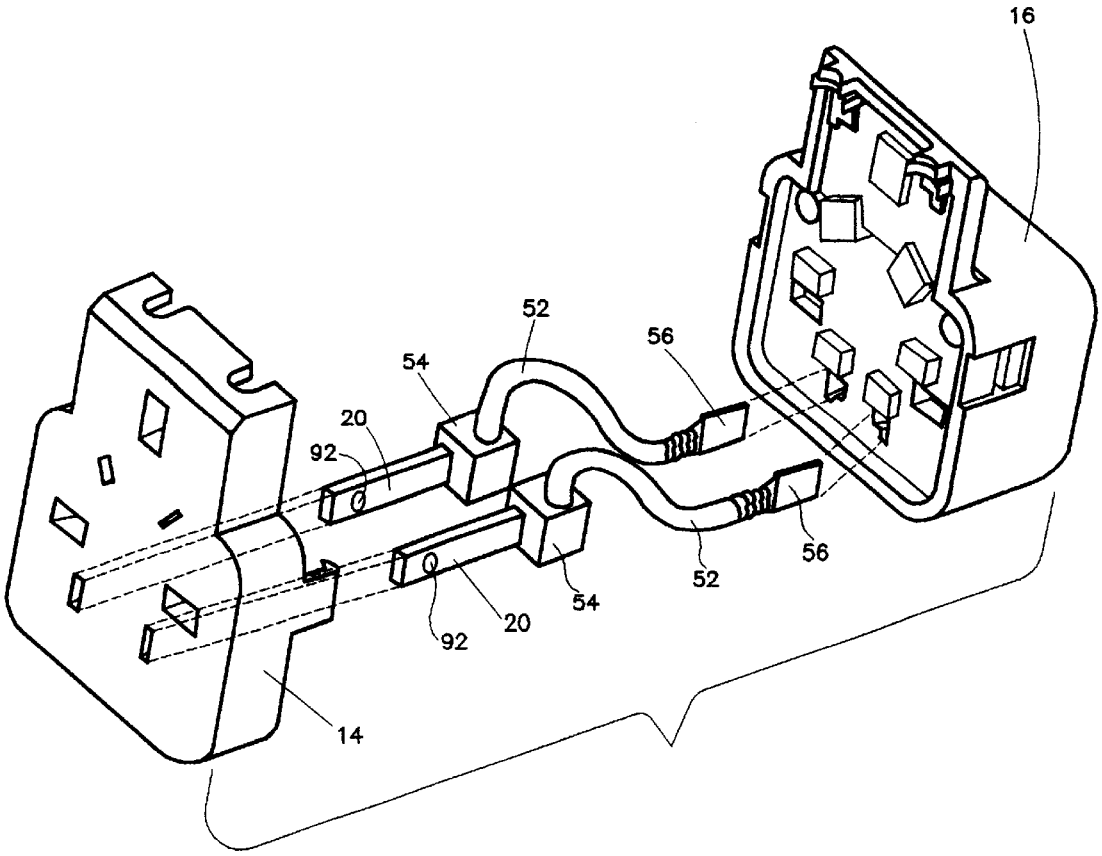
FIG. 4 is an exploded view of the first body part and the second body part of the universal adapter shown in FIG. 1.

FIGS. 4 to 6 show the internal electrical connection between the electrically conductive pins 20 and clips 50 in socket holes 36'. It can be seen that each of the pins 20 is connected to one end of a respective electric wire 52 via a connection block 54. The connection block 54 is made of an electrically insulating material, e.g. polyvinylchloride (PVC). Another end of the electric wire 52 is secured to an electrically conductive contact platelet 56, which is engaged and in electrical contact with an electrically conductive contact plate 58 of the clip 50. By way of such an arrangement, the pins 20 and the clips 50 are in electrical connection with each other.

Figure 7A:
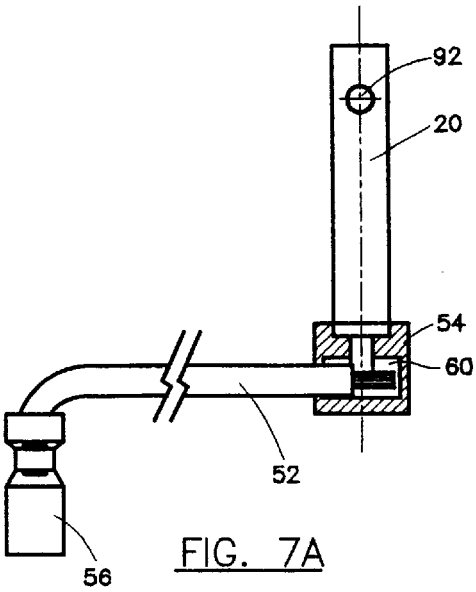
FIG. 7A is a view showing connection between the connecting platelet and the electrically conductive pin shown in FIG. 6.
Figure 7B:
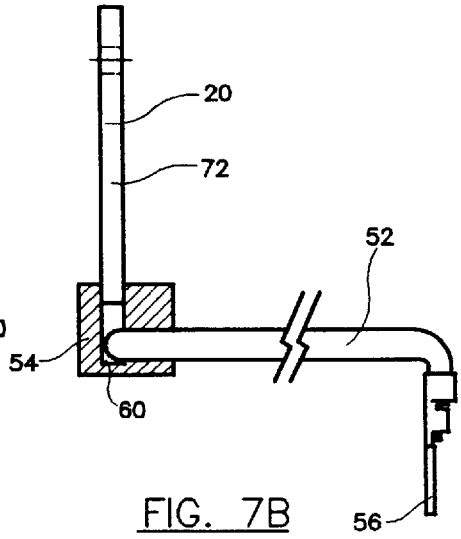
FIG 7B is a further view showing connection between the connecting platelet and the electrically conductive pin shown in FIG. 6.
Figure 8A:
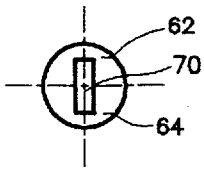
FIG. 8A is a top view of a first type of adapting pin used in the universal adapter shown in FIG. 1.
Figure 8B:
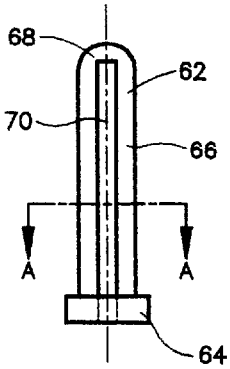
FIG. 8B is a side view of the first type of adapting pin shown in FIG. 8A.

FIGS. 7A and 7B show the manner in which the electric wire 52 is connected to the pin 20 in the connection block 54. It can be seen that the connection block 54 includes a chamber 60 with two entries. While an end of the pin 20 is inserted into the chamber 60 via one of said entries, an end of the electric wire 52 is inserted into the chamber 60 via another of said entries. In the chamber, the pin 20 is in contact with exposed copper wires in the electric wire 52 in order to establish electrical contact therewith.

Figure 9A:
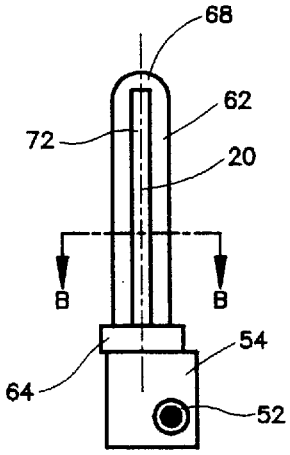
FIG. 9A is a side view of the first type of adapting pin shown in FIG. 8A as connected with an electric wire.
Figure 8C:
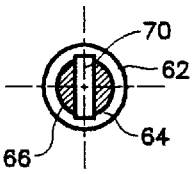
FIG. 8C is a sectional view of the first type of adapting pin taken along the line A—A in FIG. 8B.
Figure 9B:
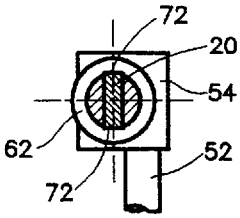
FIG. 9B is a sectional view taken along the line B—B in FIG. 9A.

To enable the pins 20 to be engageable with various types of wall sockets, adapting pins made of an electrically insulating material are provided. A first type of adapting pin 62 is shown in FIGS. 8A to 9B. The adapting pin 62 includes a circular base 64, and an elongate and substantially cylindrical pin body 66 and a hemispherical head 68. A central slot 70 is provided from the base 64 through a major portion of the length of the elongate pin body 66. The slot 70 of the adapting pin 62 is sized and configured to receive the electrically conductive pin 20, as shown in FIGS. 9A and 9B. As can be seen in FIG. 9B, when the pin 20 is so engaged with the adapting pin 62, the base 64 of the adapting pin 62 sits on the connection block 54, and two elongate side surfaces 72 of the pin 20 are exposed to the outside of pin body 66. This ensures that when the pins 20 are plugged into a wall socket of round holes, the pins 20 can come into electrical contact with the wall socket.

Figure 10A:
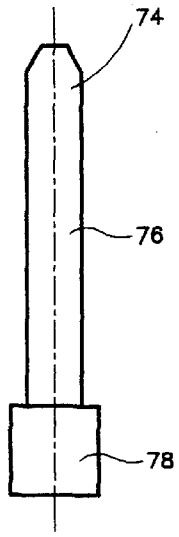
FIG. 10A is a side view of a ground pin used in the universal adapter shown in FIG. 1.
Figure 10B:
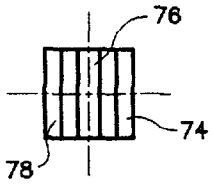
FIG. 10B is a top view of the ground pin shown in FIG. 10A.
Figure 11A:
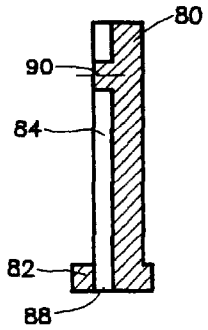
FIG. 11A is a longitudinal sectional side view of a second type of adapting pin used in the universal adapter shown in FIG. 1.
Figure 11B:
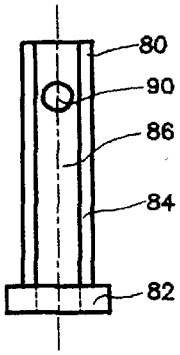
FIG. 11B is a front view of the second type of adapting pin shown in FIG. 11A.
Figure 11C:
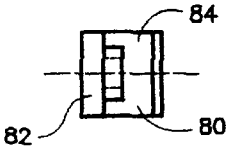
FIG. 11C is a top view of the second type of adapting pin shown in FIG. 11A.
Figure 12A:
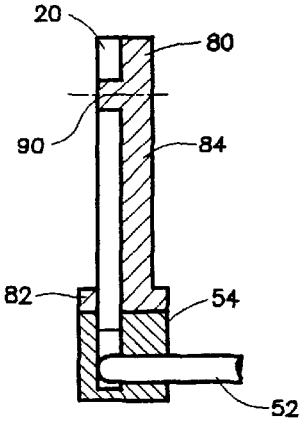
FIG. 12A is a longitudinal sectional side view showing engagement between an electrically conductive leg with the second type of adapting pin shown in FIG. 11A.
Figure 12B:
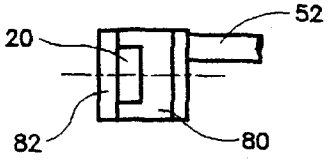
FIG. 12B is a top view showing engagement between an electrically conductive leg with the second type of adapting pin shown in FIG. 11A.

Wall sockets in England, Hong Kong, Singapore, etc., include three rectangular holes, the size of which is larger than that of the pins 20 of the adapter herein. In particular, the wall sockets in such regions include a ground pin hole for insertion of a ground pin. A safety mechanism is built into such wall socket which prohibit insertion of plugs without a ground pin. To cope with such a situation, an adapting ground pin 74 is provided, as shown in FIGS. 10A and 10B. The adapting ground pin 74 is made of an electrically insulating material and includes an elongate pin body 76 in the shape of a substantially rectangular prism and a rectangular block 78. This adapting ground pin 74 is sized and configured for insertion into the ground pin hole of BS type wall sockets.

Another type of adapting pin is shown in FIGS. 11A to 12B, and designated as 80. Such an adapting pin 80 includes a base 82 and an elongate pin body 84. A recess 86 is provided on one elongate surface of the pin body 84, which recess 86 extends through the base 82 of the adapting pin 80 in the form of a slot 88. The electrically conductive pin 20 may therefore be received in the recess 86 of the adapting pin 80 from under the base 82 through the slot 88. To better secure the pin 20 to the adapting pin 80, a protrusion 90 is provided in the recess 86 to engage with a correspondingly sized and configured opening 92 in the pin 20 (see FIGS. 4, 6 and 7A). When the pin 20 is so engaged with the adapting pin 80, the pin 20 and the elongate pin body 84 of the adapting 80 combine to form a substantially rectangular prism with a major elongate surface of the pin 20 exposed to the outside. The combined pin 20 and the adapting pin 80 can thus be inserted into wall sockets with rectangular holes for establishing electrical contact therewith.

Figure 13:
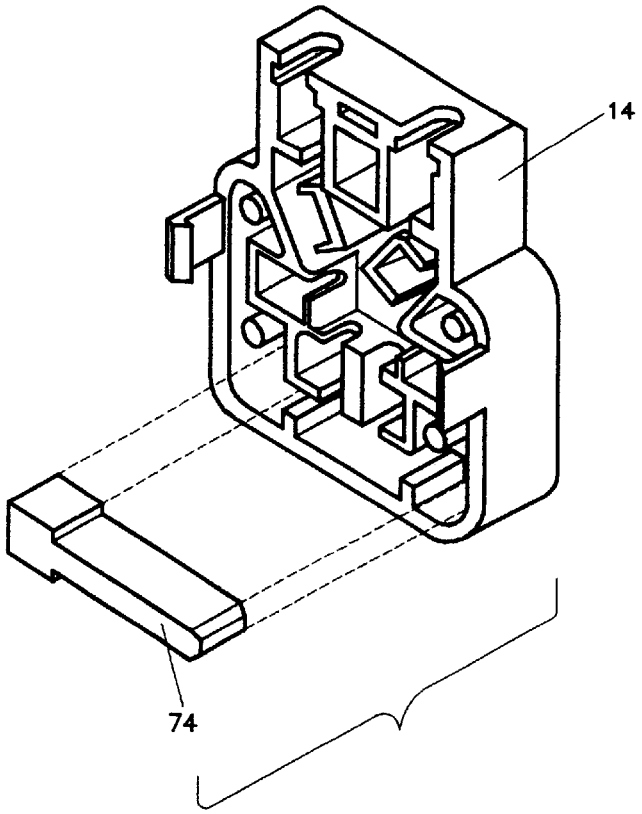
FIG. 13 shows storage of the ground pin with the first body part of the universal adapter shown in FIG. 1.
Figure 14:
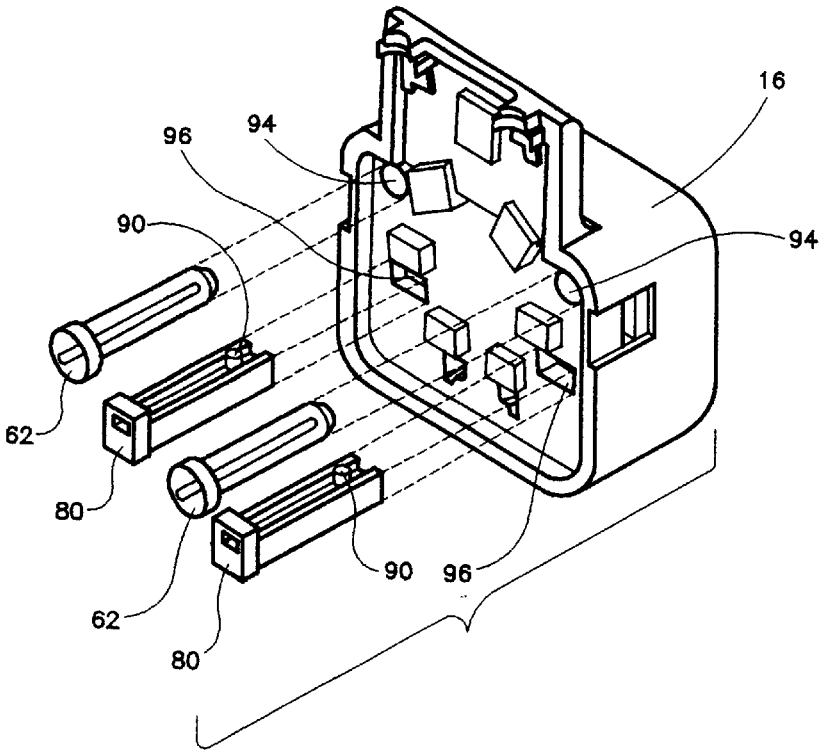
FIG. 14 shows storage of the adapting pins with the second body part of the universal adapter shown in FIG. 1.

When the adapting pins 62, 80 and the adapting ground pin 74 are not in use, they can be stored within the body portion 12 of the adapter 10. In particular, as shown in FIG. 13, the adapting ground pin 74 can be stored in a cavity of the lower part of the first body part 14. As shown in FIG. 14, the adapting pins 62 can be stored in elongate circular holes 94 of the second body part 16. As for the adapting pins 80, such can be stored in elongate rectangular holes 96 of the second body part 16. The sizes of holes 94 are smaller than that of the bases 64 of the adapting pins 62, so that the bases 64 remain outside of the holes 94 when the adapting pins 62 are stored in the holes 94. Similarly, the size of the holes 96 are smaller than the bases 82 of the adapting pins 80, so that the bases 82 remain outside of the holes 96 when the adapting pins 80 are stored in the holes 96. These pins 62, 74 and 80 may thus be retrieved for use when required.

Figure 15A:
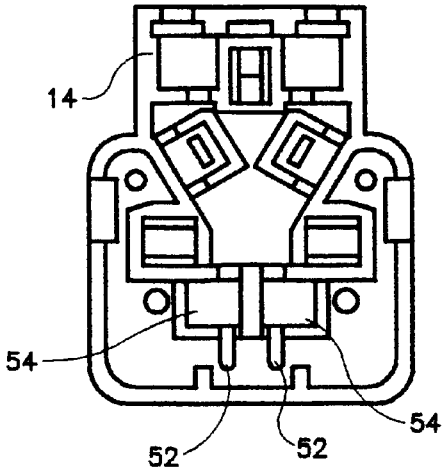
FIG. 15A is a rear view of the first body part of the universal adapter shown in FIG. 1 when the electrically conductive legs are in a first configuration.
Figure 15B:
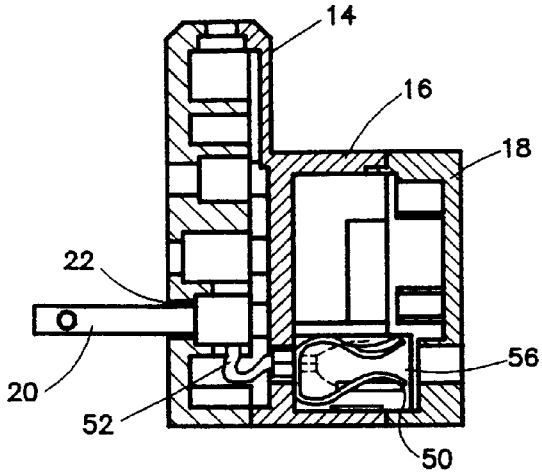
FIG. 15B is a side sectional view of the universal adapter shown in FIG. 1 when the electrically conductive legs are in a first configuration.
Figure 15C:
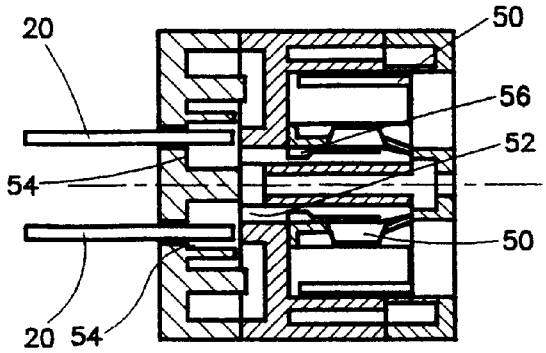
FIG. 15C is a top sectional view of the universal adapter shown in FIG. 15B.

FIGS. 15A to 15C show the arrangement of the pins 20 and the electric wires 52 when the universal adapter 10 is to be plugged into a UL type wall socket used in the US, Canada, Japan and Taiwan. In this configuration, the pins 20 are not engaged with any of the adapting pins 62 or 80, and extend through the apertures 22 of the first body part 14 of the adapter 10.

Figure 16A:
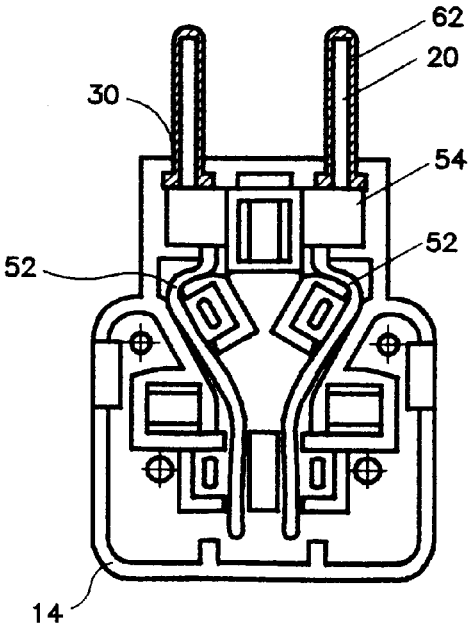
FIG. 16A is a rear view of the first body part of the universal adapter shown in FIG. 1 when the electrically conductive legs are in a second configuration.
Figure 16B:
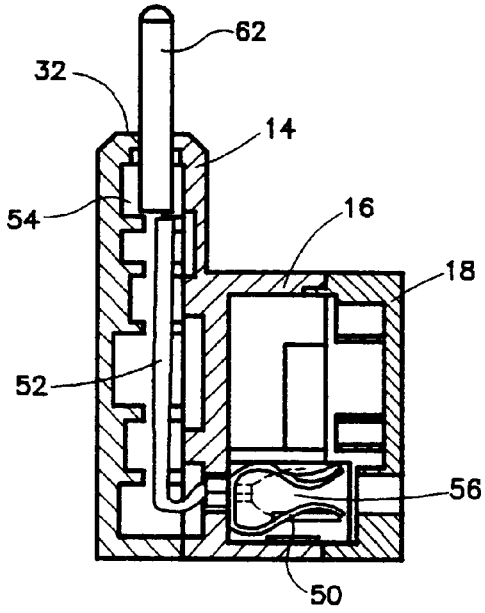
FIG. 16B is a side sectional view of the universal adapter shown in FIG. 1 when the electrically conductive legs are in a second configuration.
Figure 16C:
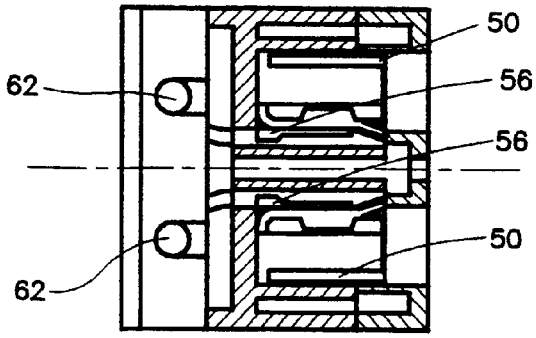
FIG. 16C is a partially sectioned top view of the universal adapter shown in FIG. 16B.

FIGS. 16A to 16C show the arrangement of the pins 20 and the electric wires 52 when the universal adapter 10 is to be plugged into a VDE type wall socket used in various European countries (except Great Britain). In this configuration, the electrically conductive pins 20 are engaged with the electrically insulating adapting pins 62 in the manner discussed above, so as to assume a substantially cylindrical outward shape for insertion into circular holes of VDE type wall sockets. The adapting pins 62 and the pins 20 extend from inside the adapter 10, out of the apertures 30 on the minor surface 32 of the first body part 14.

Figure 17A:
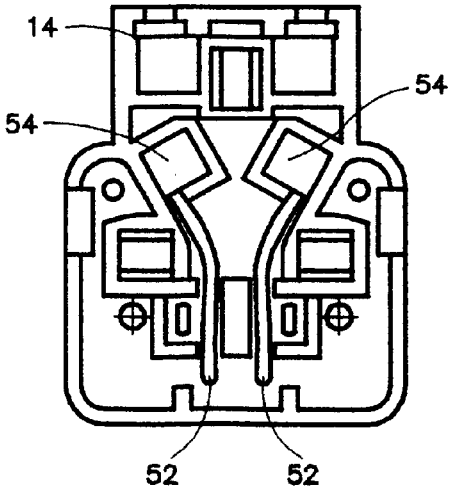
FIG. 17A is a rear view of the first body part of the universal adapter shown in FIG. 1 when the electrically conductive legs are in a third configuration.
Figure 17B:
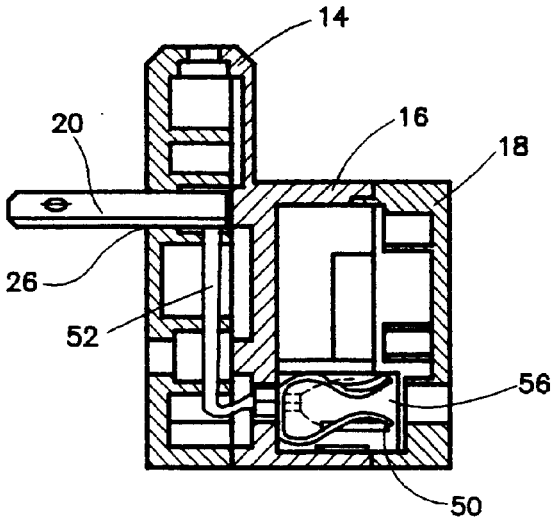
FIG. 17B is a side sectional view of the universal adapter shown in FIG. 1 when the electrically conductive legs are in a third configuration.
Figure 17C:
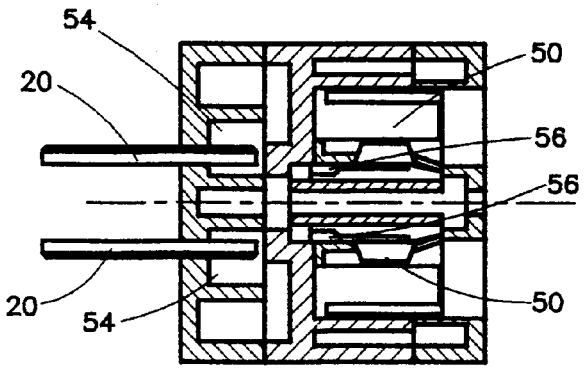
FIG. 17C is a top sectional view of the universal adapter shown in FIG. 17B.

FIGS. 17A to 17C show the arrangement of the pins 20 and the electric wires 52 when the universal adapter 10 is to be plugged into an SAA type wall socket which includes two inclined flat holes, and which is in use in Australia and New Zealand. In this configuration, the pins 20 are not engaged with any of the adapting pins 62 or 80, and extend through the apertures 26 of the first body part 14 of the adapter 10.

Figure 18A:
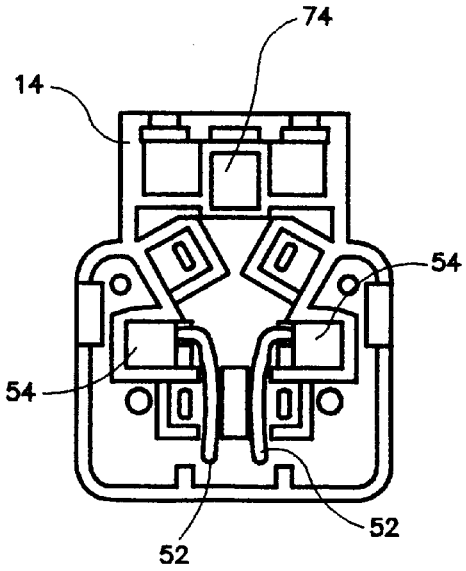
FIG. 18A is a rear view of the front body part of the universal adapter shown in FIG. 1 when the electrically conductive legs are in a fourth configuration.
Figure 18B:
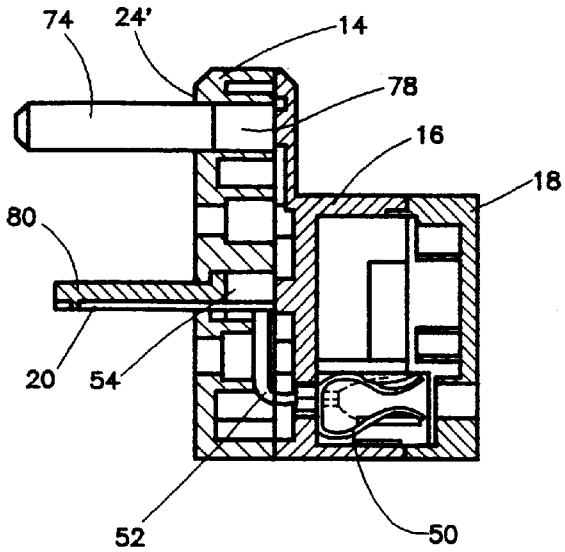
FIG. 18B is a side sectional view of the universal adapter shown in FIG. 1 when the electrically conductive legs are in a fourth configuration.
Figure 18C:
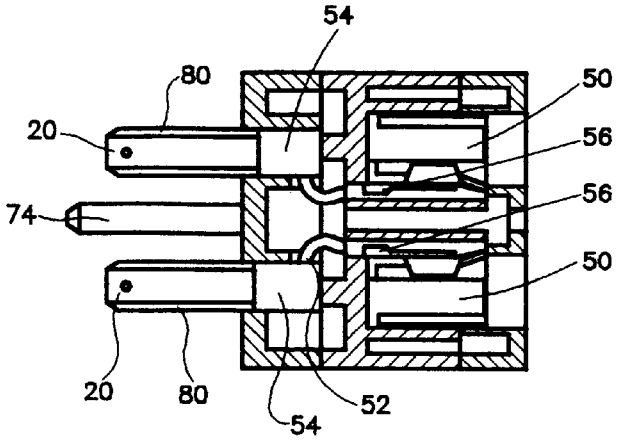
FIG. 18C is a bottom sectional view of the universal adapter shown in FIG. 18B.

FIGS. 18A to 18C show the arrangement of the pins 20 and the electric wires 52 when the universal adapter 10 is to be plugged into a BS type of wall socket used in Great Britain, Hong Kong, Singapore, etc.. Such a wall socket includes three rectangular holes, of which the middle one is for receiving a ground pin. In this configuration, the electrically insulating adapting ground pin 74 extends through the aperture 24' of the first body part 14 of the adapter 10. As to the pins 20, such are engaged with the electrically insulating adapting pins 80 for assuming the shape of a rectangular prism of a larger size. The adapting pins 80, engaged with the pins 20, extend through the apertures 24 of the first body part 14 of the adapter 10.

It can be seen that the present invention provides a compact universal adapter 10 which can be easily adjusted for use in connection with various types of wall sockets throughout the world, and can provide electricity to various electrical appliances plugged into its socket holes 36, 36'. The adapter 10 is not significantly larger than a conventional electric plug, and is relatively light, as the number of metallic components is kept to a minimum. In addition, as very few metallic components are used, the production cost is also lower than that of the prior art adapters.

It should be understood that the above only describes a preferred embodiment of the present invention, and that various modifications and alterations may be made thereto without departing from the spirit of the invention.

What is claimed is:

1. A universal adapter comprising a body and a pair of electrically conductive pin members, said body including at least a first end and a second end, wherein at least two holes are provided on said first end, said holes being adapted to be engaged with a plug of an electric appliance, wherein each of said holes is electrically connected with one of said electrically conductive pin members, wherein said electrically conductive pin members are selectively extensible through a plurality of pairs of apertures provided on said second end to engage with a socket, wherein at least two pairs of said apertures are inclined to one another at an angle, whereby said adapter is engageable with a plurality of types of sockets, and wherein said adapter further includes a third pin member made of an electrically insulating material, said third pin member being extensible through an aperture on said second end of said body to engage with a ground pin hole of a socket.

2. A universal adapter according to claim 1 wherein at least one said pair of apertures are perpendicular to another said pair of apertures.

3. A universal adapter according to claim 1 wherein at least one said pair of apertures are inclined to another said pair of apertures at an acute angle.

4. A universal adapter according to claim 1 wherein at least one said pair of apertures are inclined to another said pair of apertures at an obtuse angle.

5. A universal adapter according to claim 1 wherein at least three pairs of apertures are provided on said second end.

6. A universal adapter according to claim 5 wherein said at least three pairs of apertures provided on said second end are inclined to one another at an angle.

7. A universal adapter according to claim 1 wherein said ground pin member is wholly receivable within said body.

8. A universal adapter according to claim 1 wherein said body includes two releasably engageable body members.

9. A universal adapter comprising a body and a pair of electrically conductive pin members, said body including at least a first end and a second end, wherein at least two holes are provided on said first end, said holes being adapted to be engaged with the plug of an electric appliance, wherein each of said holes is electrically connected with said electrically conductive pin members, wherein said electrically conductive pin members are selectively extensible through a plurality of pairs of apertures provided on said second end to engage with a socket, wherein at least two pairs of said apertures are of different size, whereby said adapter is engageable with a plurality of types of sockets, and wherein said adapter further includes a third pin member made of an electrically insulating meterial, which pin member is exensible through an aperture on said second end of said body to engage with a ground pin hole of a socket.

10. A universal adapter according to claim 9 wherein said apertures are substantially rectangular in shape.

11. A universal adapter according to claim 9 wherein at least three pairs of apertures are provided on said second end.

12. A universal adapter according to claim 9 wherein said ground pin member is wholly receivable within said body.

13. A universal adapter according to claim 9 wherein said body includes two releasably engageable body members.

14. A universal adapter comprising a body and a pair of electrically conductive pin members, said body including at least a first end and a second end, wherein at least two holes are provided on said first end, said holes being adapted to be engaged with a plug of an electric appliance, wherein said holes are electrically connected with said pin members, wherein said pin members are selectively extensible through a plurality of pairs of apertures provided on said second end to engage with a socket, and wherein each of said pin members is engageable with an adapting member when said pin members extend through one of said pairs of apertures, whereby said adapter is engagable with a plurality of types of sockets.

15. A universal adapter according to claim 14 wherein said pin members are engageable with two types of adapting members.

16. A universal adapter according to claim 14 wherein said adapting member includes a base member and an elongate member, and wherein said elongate member is substantially cylindrical in shape.

17. A universal adapter according to claim 16 wherein said adapting member includes a slot for insertion of said pin member.

18. A universal adapter according to claim 14 wherein said adapting member includes a base member and an elongate member, and wherein said elongate member is substantially in the shape of a rectangular prism.

19. A universal adapter according to claim 18 wherein said adapting member includes a recess on one of its elongate surfaces for receiving said pin member.

20. A universal adapter according to claim 14 wherein said body includes two releasably engageable body members.

21. A universal adapter according to claims 20 wherein said adapting members are wholly receivable within said body.

22. A universal adapter according to claim 20 wherein at least one of said body members includes a plurality of recesses each for receiving therethrough at least part of one of said adapting members.

23. A universal adapter comprising a body and a pair of electrically conductive pin members, said body including at least a first end and a second end, wherein at least two holes are provided on said first end, said holes being adapted to be engaged with a plug of an electric appliance, wherein said holes are electrically connected with said pin members, wherein said pin members are selectively extensible through a plurality of pairs of apertures provided on said second end to engage with a socket, wherein said second end includes at least a first surface and a second surface which are substantially perpendicular to each other, and wherein at least one pair of apertures is provided on each of said first and second surface(s).

24. A universal adapter according to claim 23 wherein a plurality of pairs of apertures are provided on said second surface.

25. A universal adapter according to claim 23 wherein the pair of apertures provided on said first surface are substantially circular in shape.

26. A universal adapter according to claim 24 wherein at least three pairs of apertures are provided on said second surface.

27. A universal adapter according to claim 23 wherein an aperture is provided on said second surface for extending a ground pin member therethrough.

28. A universal adapter according to claim 27 wherein said ground pin member is made of electrically insulating material, which third pin member is extensible through said aperture on said second surface of said second end of said body to engage with a ground pin hole of a socket.

29. A universal adapter according to claim 27 wherein said ground pin member is wholly receivable within said body.

30. A universal adapter according to claim 23 wherein said body includes two releasably engageable body members.

* * * * *